US006109958A

United States Patent [19]

Ke

[11] Patent Number: 6,109,958

[45] Date of Patent: Aug. 29, 2000

[54] STRUCTURE OF A MULTI-FUNCTIONAL UNINTERRUPTED POWER SUPPLY (UPS)

[76] Inventor: Jenn-Bin Ke, P.O. Box 82-144, Taipei, Taiwan

[21] Appl. No.: 09/139,578

[22] Filed: Aug. 25, 1998

[51] Int. Cl.[7] ..... H01R 13/60

[52] U.S. Cl. ..... 439/535; 439/535; 439/501; 439/652; 439/654

[58] Field of Search ..... 439/535, 501, 439/652, 654, 942

[56] References Cited

U.S. PATENT DOCUMENTS

| | | | |
|---|---|---|---|
| 4,067,526 | 1/1978 | Storer | 248/65 |
| 5,122,082 | 6/1992 | Lee | 439/652 |
| 5,171,155 | 12/1992 | Mendoza | 439/134 |
| 5,469,844 | 11/1995 | Rogler | 128/630 |
| 5,562,488 | 10/1996 | Neiser et al. | 439/501 |
| 5,844,763 | 12/1998 | Grace et al. | 361/111 |
| 5,906,517 | 9/1997 | Crane et al. | 439/645 |

*Primary Examiner*—Paula Bradley
*Assistant Examiner*—Truc Nguyen
*Attorney, Agent, or Firm*—A & J

[57] ABSTRACT

A structure of a multi-functional uninterrupted power supply includes a body portion having one end provided with a control panel, two opposite sides each having a socket portion provided with three blocks, each of the blocks being provided with a receptacle, one of the blocks being a polygonal member arranged at an intermediate position of the socket portion and having a distance from a top of the body portion, a second one of the blocks being a rectangular member arranged at a corner of the socket portion, a third one of the blocks being arranged at another corner of the socket portion, and another end provided with at least a hook, the body portion having a top formed with a recess and a plurality of slots, and a plurality of fixing members engageable with the slots, whereby the cables connecting peripherals to a power supply and a host computer can be conveniently kept in order.

1 Claim, 6 Drawing Sheets

STRUCTURE OF A MULTI-FUNCTIONAL UNINTERRUPTED POWER SUPPLY (UPS)

BACKGROUND OF THE INVENTION

1. Field of the Invention

This invention is related to an improved structure of a multi-functional uninterrupted power supply.

2. Description of the Prior Art

The popularity of internet and multi-media computers results in the needs for more basic peripherals. Generally, a computer system includes a host computer, a monitor, a modem, a speaker, a printer, etc. and so there must be at least five receptacles for supplying power to the peripherals. However, a plurality of cables for connecting the peripherals to the power supply and the host computer are all arranged behind the host computer thereby making them easily get entangled with one another. In addition, in order to increase the available area of the desk top, most users will put the host computer on the floor thus subjecting the host computer to dust and dampness and therefore shortening the service life of the host computer.

Furthermore, there is a tendency for personal computers to accomplish multitask operation, and so it is not permitted to turn off the host computer as one pleases. In addition, the operating system WINDOWS 98 has set uninterrupted power supply as the basic periphery for supplying backup power for a computer system when the electrical power fails or drops to an unacceptable voltage level. However, the conventional uninterrupted power supply has only four receptacles and must be connected with an adapter plug thus increasing its volume and further decreasing the available area of the desk top.

Therefore, it is an object of the present invention to provide an improved structure of uninterrupted power supply which can obviate and mitigate the above-mentioned drawbacks.

SUMMARY OF THE INVENTION

This invention is related to an improved structure of a multi-functional uninterrupted power supply.

It is the primary object of the present invention to provide a structure of a multi-functional uninterrupted power supply which has a plurality of receptacles at both sides thereby solving the problem of insufficient receptacles of the conventional uninterrupted power supply.

It is another object of the present invention to provide a structure of a multi-functional uninterrupted power supply which can keep the cables connecting peripherals to a host computer in order.

It is still another object of the present invention to provide structure of a multi-functional uninterrupted power supply which is mounted under a host computer thereby saving the availing area of the desk top.

It is still another object of the present invention to provide structure of a multi-functional uninterrupted power supply which can separate the host computer from the floor thereby preventing the host computer from subjecting to dampness and dust and therefore increasing the service life of the host computer.

It is a further object of the present invention to provide structure of a multi-functional uninterrupted power supply which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
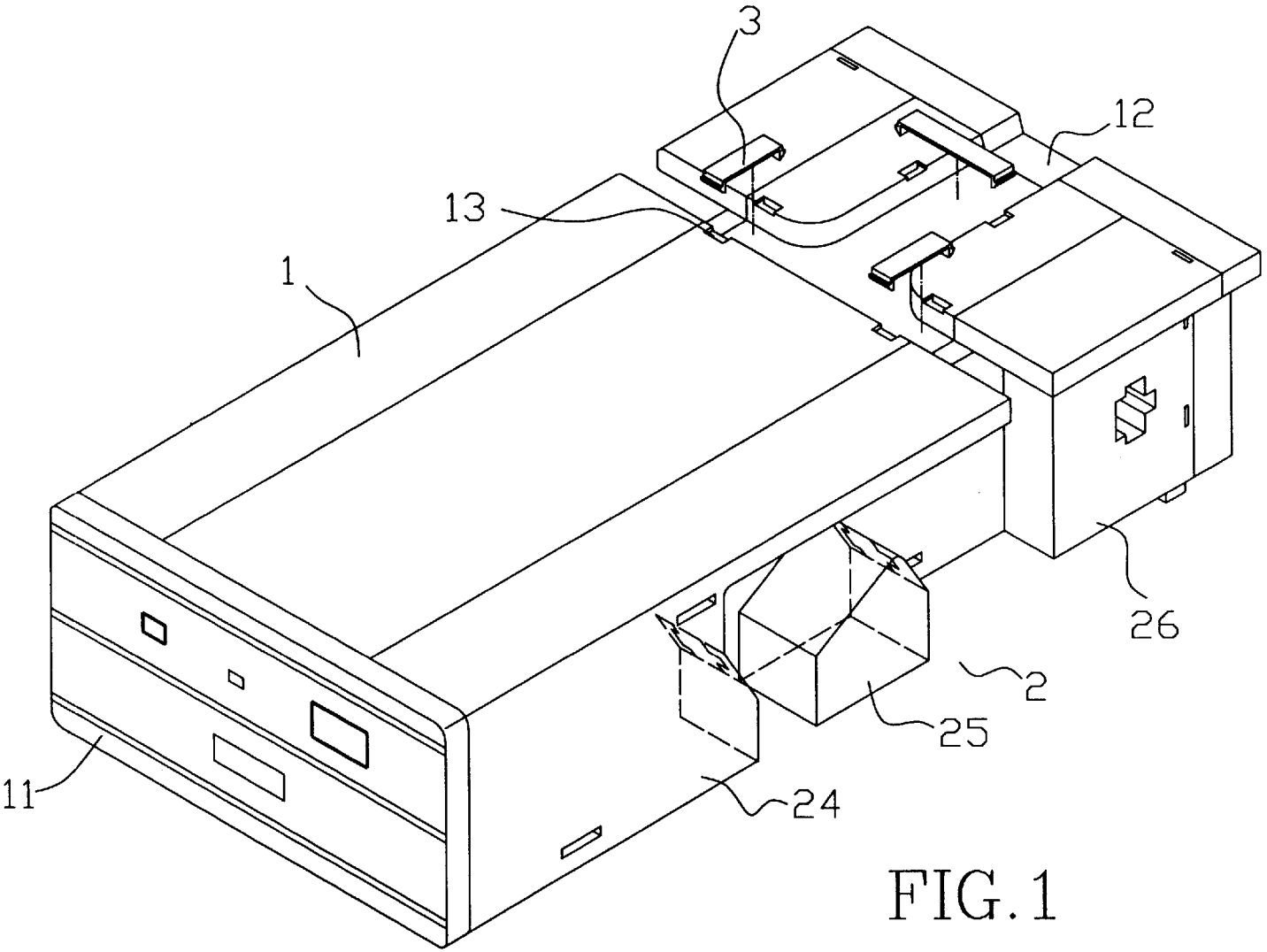
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figures 2, 2A:
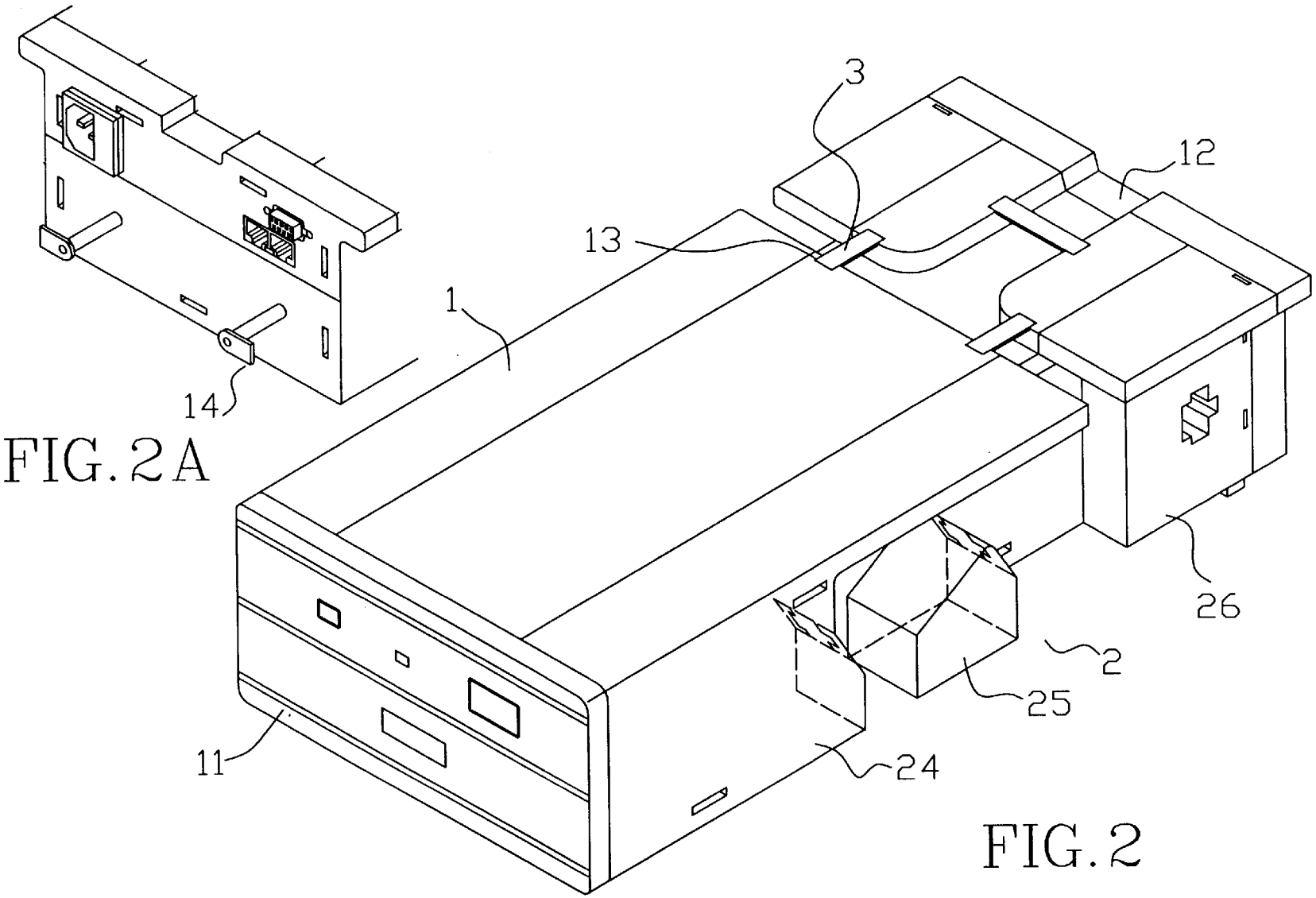
FIG. 2 is a perspective view of the present invention.
FIG. 2A illustrates the rear side of the present invention.

With reference to the drawings and in particular to FIGS. 1, 2 and 2A, the multi-functional uninterrupted power supply according to the present invention generally comprises a body portion 1 and a plurality of fixing members 3.

The body portion 1 is a rectangular member made of plastic and dimensioned to arrange on the bottom of a host computer. The front side of the body portion 1 is provided with a control panel 11. Both sides of the body portion 1 have a socket portion 2 provided with three blocks 24, 25 and 26 each having a receptacle with a cross-shaped slot. The block 25 is a polygonal member arranged at the intermediate position of the socket portion 2 and has a distance from the top of the body portion 1 for the passage of cables. The block 26 is a rectangular member arranged at the corner of the socket portion 2. The block 24 is arranged at another corner of the socket portion 2. The top of the body portion 11 is formed with a T-shaped recess 12 for receiving cables. The T-shaped recess 12 has a plurality of slots 13 adapted to engage with fixing members 3 for keeping cables in place. The rear end of the body portion 1 is provided with two L-shaped hooks 14 for winding cables. The top of the body poortion 1 is configured so that it has the same width as the bottom of a host computer. The fixing member 3 is an inverted U-shaped member having two upwardly extending hooks adapted to engage with the slots 13 for keeping cables at a fixed position.

Figure 3:
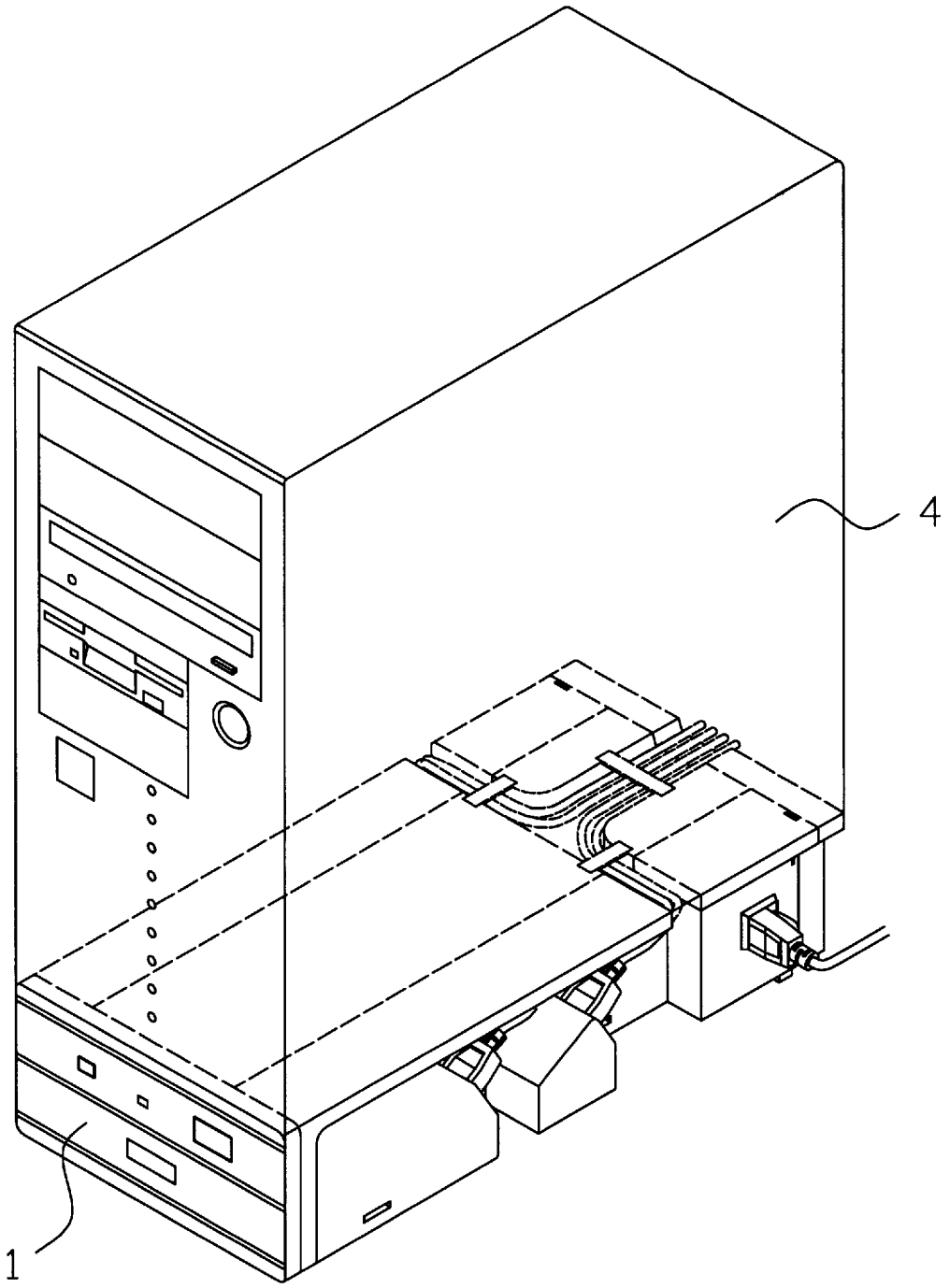
FIG. 3 illustrates how to mount the present invention under a host computer.
Figures 4, 4A:
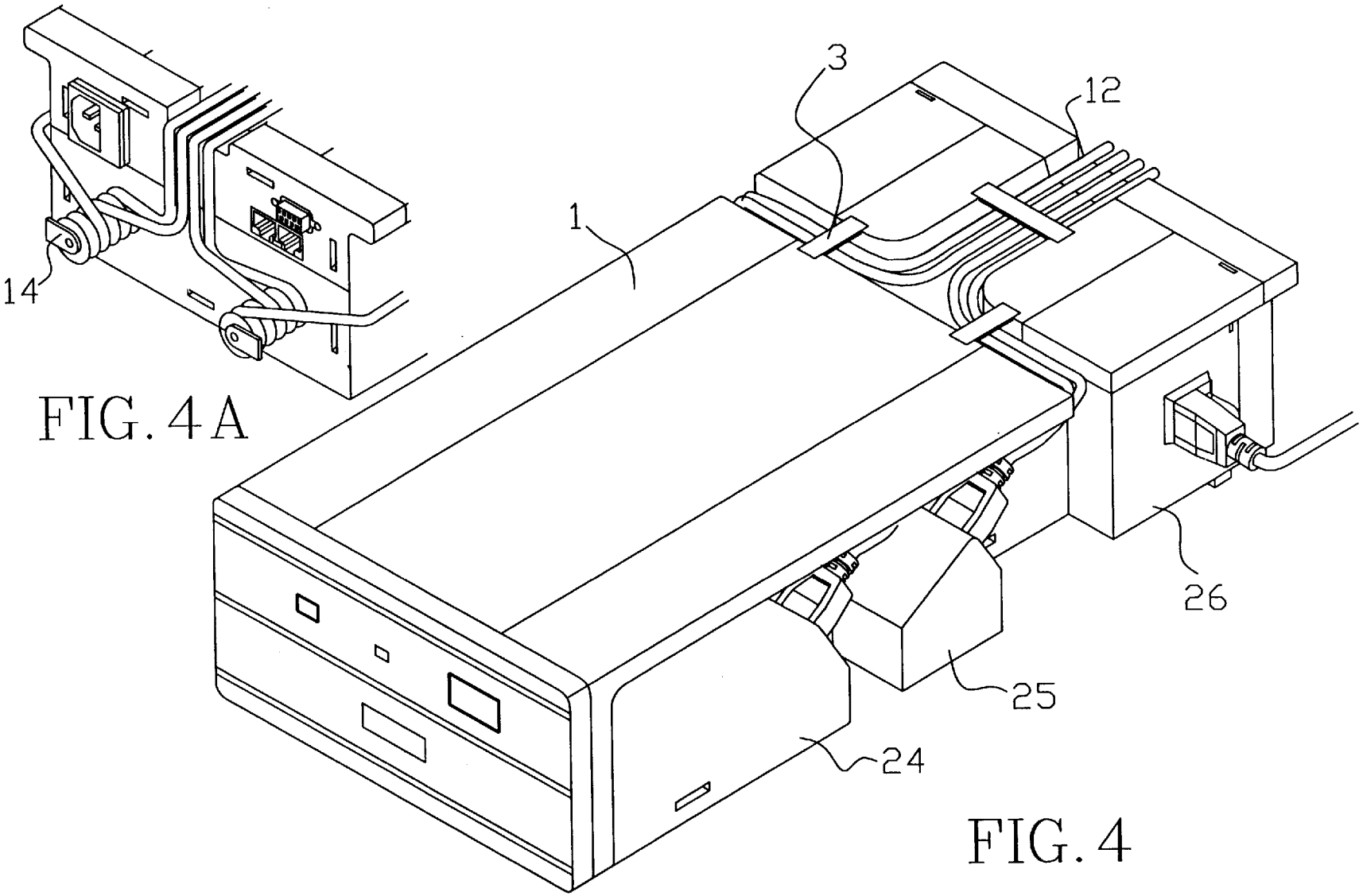
FIG. 4 is a working view of the present invention.
FIG. 4A illustrates how to wind electrical wires on the hooks at the rear end of the present invention.
Figure 5:
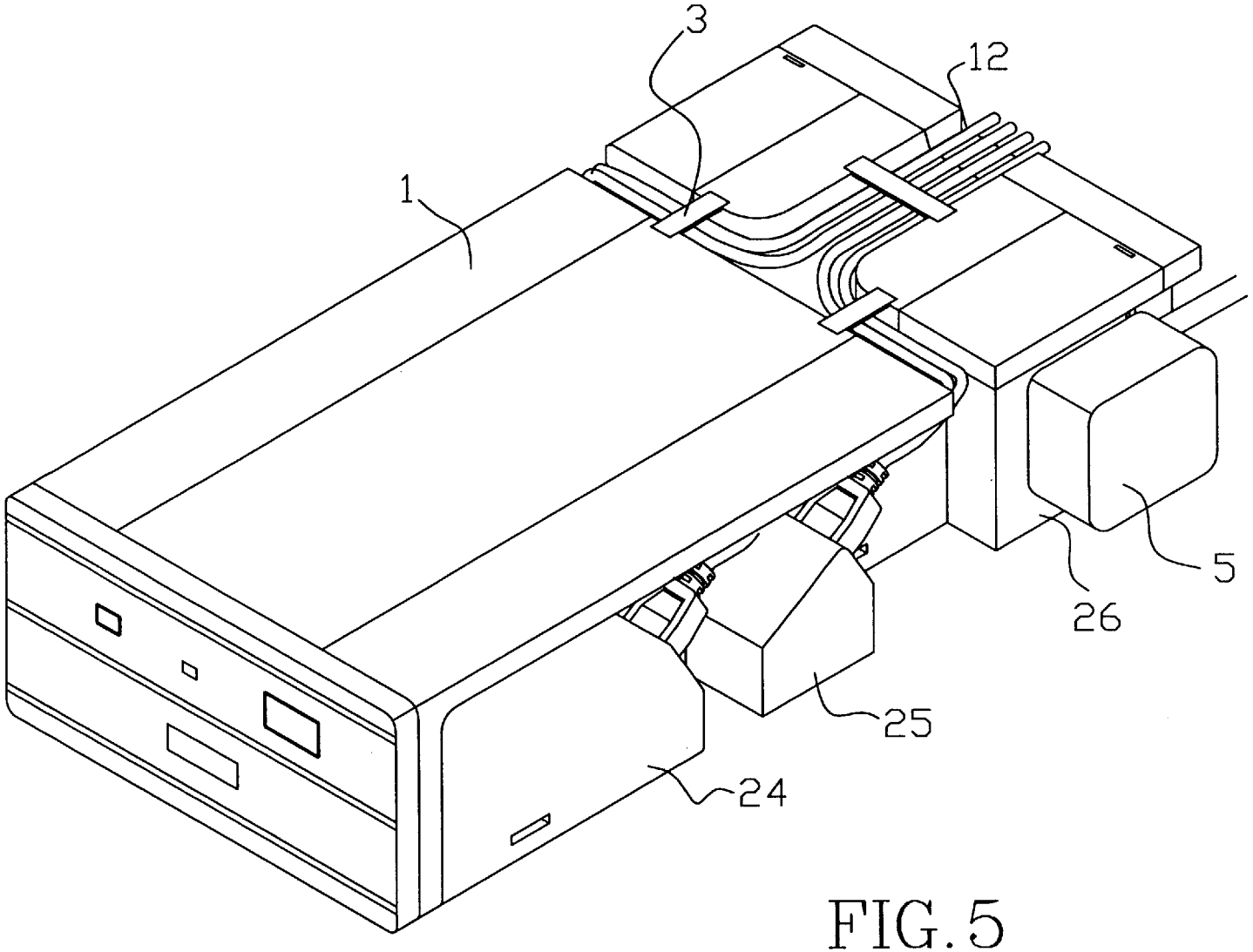
FIG. 5 is another working view of the present invention.
Figure 6:
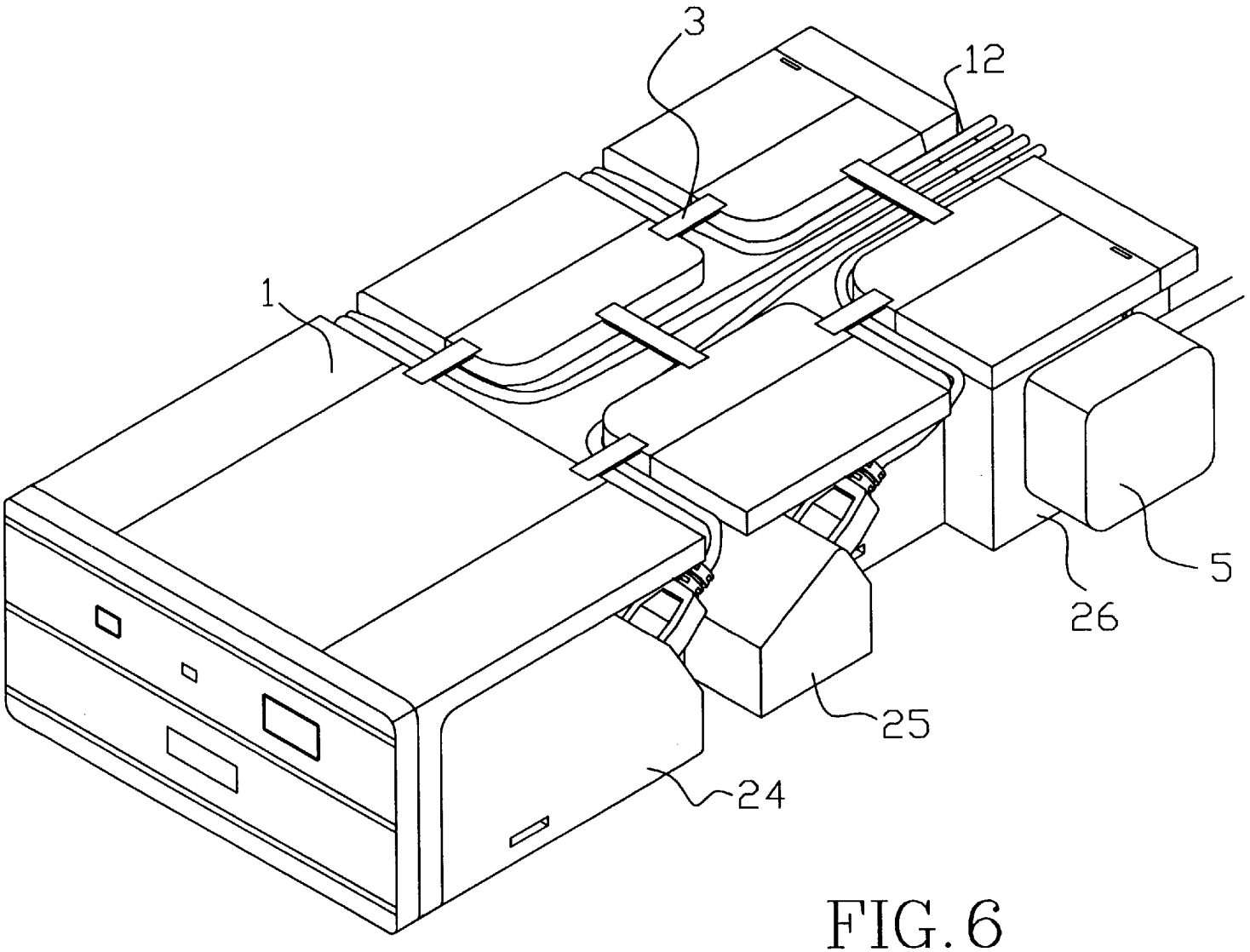
FIG. 6 illustrates a second preferred embodiment according to the present invention.

Referring to FIGS. 3, 4 and 4A, the uninterrupted power supply according to the present invention is arranged on the bottom of a host computer 4 and the plugs of the host computer 4, monitor, modem, loudspeaker, printer, . . . etc. are engaged with the socket portion 2, with their power cables fitted in the T-shaped recess 12 and kept in place by the fixing members 3. The remaining portions of the cables are wound on the L-shaped hooks 14 at the rear side of the body portion 1 (see FIG. 4A). Further, an adapter 5 can be conveniently pluged into the socket on the block 26 (see FIG. 5). In addition, the top of the body portion 1 may be formed with a second T-shaped recess 15 communicated with the first T-shaped recess 15 (see FIG. 6).

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A structure of a multi-functional uninterrupted power supply comprising:

a rectangular body portion made of plastic and dimensioned to be arranged on a bottom of a host computer, said body portion having one end provided with a control panel, two opposite sides each having a socket portion provided with three blocks, each of said blocks being provided with a receptacle, one of said blocks being a polygonal member arranged at an intermediate position of said socket portion and having a distance from a top of said body portion, a second one of said blocks being a rectangular member arranged at a comer of said socket portion, a third one of said blocks being arranged at another corner of said socket portion, and another end provided with at least an L-shaped hook for winding cables, said body portion having a top formed with a recess composed of two T-shaped passages for receiving cables, said recess being provided with a plurality of slots, and a plurality of U-shaped fixing members having two downwardly extending hooks configured to engage with said slots so as to keep the cables in place, said top of said body portion having the same width as a bottom of a host computer, said second electrical socket being locate at a distance from said top of said body portion, said first block having a receptacle at an outer side thereof, each of said blocks having a plus-shaped socket.

* * * * *